US009561512B2

(12) United States Patent
Bittner et al.

(10) Patent No.: US 9,561,512 B2
(45) Date of Patent: Feb. 7, 2017

(54) AMINE AND DIAMINE COMPOUNDS AND THEIR USE FOR INVERSE FROTH FLOTATION OF SILICATE FROM IRON ORE

(75) Inventors: Christian Bittner, Bensheim (DE); Bernhard Ulrich von Vacano, Mannheim (DE); Alexsandro Berger, Rosenheim (DE); Roland Boehn, Maxdorf (DE); Guenter Oetter, Frankenthal (DE); Joerg Nieberle, Wachenheim (DE)

(73) Assignee: BASF SE, Ludwigshafen (DE)

( * ) Notice: Subject to any disclaimer, the term of this patent is extended or adjusted under 35 U.S.C. 154(b) by 380 days.

(21) Appl. No.: 14/110,646

(22) PCT Filed: Apr. 10, 2012

(86) PCT No.: PCT/EP2012/056396

§ 371 (c)(1),
(2), (4) Date: Oct. 8, 2013

(87) PCT Pub. No.: WO2012/139985

PCT Pub. Date: Oct. 18, 2012

(65) Prior Publication Data

US 2014/0048455 A1 Feb. 20, 2014

Related U.S. Application Data

(60) Provisional application No. 61/474,756, filed on Apr. 13, 2011.

(30) Foreign Application Priority Data

Apr. 13, 2011 (EP) ..... 11162156

(51) Int. Cl.
*B03D 1/02* (2006.01)
*B03D 1/01* (2006.01)
*B03D 1/016* (2006.01)

(52) U.S. Cl.
CPC ..... *B03D 1/01* (2013.01); *B03D 1/016* (2013.01); *B03D 1/02* (2013.01); *B03D 2201/02* (2013.01); *B03D 2201/04* (2013.01); *B03D 2201/06* (2013.01); *B03D 2203/04* (2013.01)

(58) Field of Classification Search
None
See application file for complete search history.

(56) References Cited

U.S. PATENT DOCUMENTS

| | | | | |
|---|---|---|---|---|
| 2,629,494 | A | 2/1953 | Brown | |
| 3,363,758 | A | 1/1968 | Cronberg et al. | |
| 4,319,987 | A | 3/1982 | Shaw et al. | |
| 4,422,928 | A | 12/1983 | McGlothlin et al. | |
| 4,652,273 | A | 3/1987 | Maldonado et al. | |
| 6,076,682 | A | 6/2000 | Gustafsson et al. | |
| 6,963,014 | B1 | 11/2005 | Zeller et al. | |
| 8,701,892 | B2 * | 4/2014 | Gustafsson | B03D 1/01 209/166 |
| 2010/0213105 | A1 * | 8/2010 | De Oliveira Filho | B01F 3/0807 209/167 |

FOREIGN PATENT DOCUMENTS

| | | | |
|---|---|---|---|
| CA | 1100239 | A | 4/1981 |
| JP | 58-108297 | A | 6/1983 |
| JP | 101058546 | A | 10/2007 |
| WO | WO 2008/077849 | A1 | 7/2008 |

OTHER PUBLICATIONS

International Search Report and Written Opinion issued Dec. 6, 2012 in PCT/EP2012/056396.

International Preliminary Report on Patentability and Written Opinion issued Oct. 24, 2013 in PCT/EP2012/056396.

"1-Propanamine, 3-(tridecyloxy)-, branched-Compound Summary", PubChem Compound CID 22833357, XP-55033682, May 12, 2007, Retrieved from the Internet: URL:http://pubchem.ncbi.nlm.nih.gov/summary/summary.cgi?cid=22833357, 1 page.

W. L. Freyberger et al., "Quartz Flotation with Branched Chain Ether Amines", Interfacial Phenomena in Mineral Processing: Proceedings of the Engineering Foundation Conference, XP-009161399, Jan. 1, 1982, pp. 255-270.

Srdjan M. Bulatovic: "Ether Amines", Handbook of Flotation Reagents: Chemistry, Theory and Practice, XP-55033529, Jan. 1, 2007, p. 36 and cover page.

A. C. Araujo et al., "Reagents in Iron Ores Flotation", Minerals Engineering, vol. 18, No. 2, XP-027815644, Feb. 1, 2005, pp. 219-224.

R. M. Papini et al., "Cationic Flotation of Iron Ores: Amine Characterization and Performance", Minerals and Metallurgical Processing, vol. 18, No. 1, XP-009090087, Jan. 1, 2001, pp. 5-9.

R. M. F. Lima et al., "Influence of the Degree of Neutralization of Amines in Iron Ore Reverse Flotation", Informacion Technologica, vol. 13, No. 5, XP-009128945, Jan. 1, 2002, pp. 3-7.

Office Action issued Apr. 19, 2016 in Japanese Patent Application No. 2014-504268 (English translation only).

* cited by examiner

*Primary Examiner* — Thomas M Lithgow
(74) *Attorney, Agent, or Firm* — Oblon, McClelland, Maier & Neustadt, L.L.P.

(57) ABSTRACT

Compounds of the formulae: RO—X—$NH_2$ (Ia); RO—X—$NH_3^+Y^-$ (Ib); RO—X—NH—Z—$NH_2$ (IIa); and RO—X—NH—Z—$NH_3^+Y^-$ (IIb), in which X is an aliphatic alkylene group containing 2 to 6 carbon atoms; Z is an aliphatic alkylene group containing 2 to 6 carbon atoms; $Y^-$ is an anion; and R is an aliphatic iso $C_{13}H_{27}$-group with average branching degree ranging from 1.5 to 3.5. The compounds are particularly suitable as flotation collectors for enriching an iron mineral from a silicate-containing iron ore.

15 Claims, No Drawings

AMINE AND DIAMINE COMPOUNDS AND THEIR USE FOR INVERSE FROTH FLOTATION OF SILICATE FROM IRON ORE

The present invention relates to a process for enriching an iron mineral from a silicate-containing iron ore by carrying out an inverse ore flotation process using alkyl ether amines and/or alkyl ether diamines. The invention also relates to novel ether amines and alkyl ether diamines and formulations containing the same.

Removal of $SiO_2$ from different ores by froth flotation and hydrophobic amines is a well known process and is described for example by S. R. Rao in *Surface Chemistry of Froth Flotation*, Volume 1 and 2, 2nd edition, Kluwer Academic/Plenum Publishers, New York 2004. The negatively charged silicate can be hydrophobized using suitable amines. Injection of air in a flotation cell leads to formation of hydrophobic gas bubbles, which can transport the hydrophobized silicate particle to the top of the flotation cell. At the top a froth, which can be stabilized by a suitable frother, collects the silicate particles. Finally, the froth will be removed from the surface and the enriched mineral is left at the bottom of the flotation cell.

In the case of iron ore, pure material is necessary to make high quality steel. Therefore the iron mineral can be enriched from a silicate-containing iron ore by inverse flotation. This kind of froth is carried out in the presence of a depressing agent for the iron mineral and collecting agent, which can contain hydrophobic amines, for instance alkyl ether amines and/or alkyl ether diamines.

In U.S. Pat. No. 2,629,494 (Attapulgus Minerals+Chemicals Corp., publication date 24 Feb. 1953) protonated hydrophobic amines like tetradecylamine acetate are described to remove silicate from iron oxide in the presence of starch as depressing agent.

U.S. Pat. No. 3,363,758 (Ashland Oil and Refining Company, publication date 16 Jan. 1968) relates to a froth flotation process for separating silica from an ore employing a water dispersible aliphatic ether diamine of the formula $R—O—CH_2CH(R")CH_2NHCH_2CH(R")CH_2—NH_2$ in which R is an aliphatic radical having between one and 13 carbon atoms and R" is a hydrogen atom or a methyl group.

In CA1100239 (Akzona, Inc., publication date 28 Apr. 1981) alkyl ether diamines of the structure alkoxy $—CH_2CH_2CH_2—NH—CH_2CH_2CH_2—NH_2$ for removal of silicate from iron ore were described. Alkoxy unit should contain 6 to 22 carbon atoms and could be linear or branched. The disadvantage of linear alkoxy moieties is that the collector starts to crystallize with time. Additional solvent or a heating unit would be necessary to enable a liquid dosage.

Exxon Research and Engineering Co described in U.S. Pat. No. 4,319,987 (publication date 16 Mar. 1982) the use of alkoxy $—CH_2CH_2CH_2—NH_2$ for removal of silicate from iron ore. Alkoxy unit should contain 8-10 carbon atoms and should be branched.

U.S. Pat. No. 4,422,928 (Exxon Research and Engineering, publication date 27 Dec. 1983) reveals a froth flotation process for separating silica from iron ore employing a liquid aliphatic ether amine of the formula $R—O—(R^1—O)_2—CH_2—CH_2—CH_2—NH_2$ in which R is an aliphatic methyl branched radical having nine carbon atoms, $R_1$ is ethyl or propyl and z is an integer from zero to 10.

In U.S. Pat. No. 6,076,682 (AKZO NOBEL NV, publication date 20 Jun. 2000) combinations out of ether amines and ether polyamines for inverse iron ore flotation were described. Especially structures alkoxy $—CH_2CH_2CH_2—NH_2$ with alkoxy consisting out of 8 to 12 carbon atoms and alkoxy $—CH_2CH_2CH_2—NH—CH_2CH_2CH_2—NH_2$ with alkoxy consisting out of 8 to 14 carbon atoms were preferred.

WO 2008/077849 (AKZO NOBEL NV, publication date 3 Jul. 2008) describes a collecting composition for use in enriching an iron mineral from a silicate containing iron or containing coarse silicates having a $K_{80}$ value of at least 110 μm by reverse flotation of the ore. The composition contains a mixture of at least one diamine of the formula $R^1O\text{-}A\text{-}NH(CH_2)_nNH_2$, in which $R^1$ is a straight or branched hydrocarbyl group which 12 to 15 carbon atoms, A is a group $—CH_2CHXCH_2—$, in which X is hydrogen or a hydroxyl group; at least one amine of the formula $R^2(O\text{-}A)_x\text{-}NH_2$, in which $R^2$ is a straight or branched hydrocarbyl group with 12 to 24 carbon atoms, x=0 or 1, and A is as defined before; and at least one diamine of the formula $R^3(O\text{-}A)_y\text{-}NH(CH_2)_nNH_2$, in which $R^3$ is a straight or branched hydrocarbyl group with 16 to 24 carbon atoms, y=0 or 1, and A is as defined before. Included in the lists of possible groups for each of $R^1$ and $R^2$ is methyl branched C13 alkyl (isotridecyl).

Despite a significant number of proposed structures in inverse iron ore flotation more selective compounds are needed because quality of ore has been decreasing. With higher $SiO_2$ content in the ore a selective removal of silicate is more difficult than in the past with ores of higher quality. Loss of iron ore in the flotation process should be avoided and silicate content should be decreased to a very low level especially for direct reduction processes (DRI-pellets). It would be desirable to provide suitable flotation collectors and processes of selective removal of silicate from iron ore which overcome the aforementioned disadvantages. Furthermore, it would be desirable to provide flotation collectors which can be conveniently employed in flotation processes. It is particularly desirable for such floatation collectors to be in a liquid form.

In accordance with the present invention we provide each of the novel compounds of the formulae:

$$RO—X—NH_2 \quad \text{(Ia);}$$

$$RO—X—NH_3^+Y^- \quad \text{(Ib);}$$

$$RO—X—NH—Z—NH_2 \quad \text{(IIa); and}$$

$$RO—X—NH—Z—NH_3^+Y^- \quad \text{(IIb),}$$

in which

X is an aliphatic alkylene group containing 2 to 6 carbon atoms;

Z is an aliphatic alkylene group containing 2 to 6 carbon atoms;

$Y^-$ is an anion; and

R is an aliphatic iso $C_{13}H_{27}$-group with average branching degree ranging from 1.5 to 3.5.

The X and Z aliphatic alkylene groups may each independently be linear or branched when containing 3 to 6 carbon atoms.

The present invention also relates to the use of at least one of the compounds of formulae (Ia), (Ib), (IIa), and/or (IIb) as flotation collectors for enriching an iron mineral from a silicate-containing iron ore.

In accordance with the present invention any of the compounds of formulae (Ia), (Ib), (IIa) or (IIb) provide improved results in enriching the iron material. Preference may be given to using a combination of these compounds.

For instance an alkyl ether amine compound (Ia) may be used in combination with a protonated alkyl ether amine compound (Ib). Alternatively an alkyl ether diamine compound (IIa) may be used in combination with a protonated alkyl ether diamine compound (IIb). It may also be desirable to use a combination of all four compounds of formulae (Ia), (Ib), (IIa), and (IIb).

The invention further relates to compositions suitable for use in enriching an iron mineral from a silicate-containing iron ore comprising of at least one of the compounds of formulae (Ia), (Ib), (IIa), and/or (IIb). The use of said formulations as collecting formulations for enriching an iron mineral from a silicate-containing iron ore is also claimed. Compositions containing a combination of these compounds as recited above may also be used.

In addition the invention also relates to a process for enriching an iron mineral from a silicate containing iron ore by inverse flotation using a collector comprising at least one of the compounds of formulae (Ia), (Ib), (IIa), and/or (IIb) or a collector formulation comprising compositions comprising of at least one of the compounds of formulae (Ia), (Ib), (IIa), and/or (IIb).

When the compounds of formulae (Ia), (Ib), (IIa), and/or (IIb) are used as collectors or in collector formulations in an inverse flotation process a much better selection removal of silicate is achieved by comparison to commercially available or other known alkyl ether amines or other known collectors. The present invention provides improved removal of silicate without suffering an increased loss of the iron mineral. In fact the collectors of the present invention enable a higher proportion of the iron to be retained and a higher proportion of the silicate to be removed.

In a preferred form X is an aliphatic alkylene group containing between 2 and 4 carbon atoms and especially three carbon atoms. It is particularly preferred that the alkylene group has the structure —$CH_2CH_2CH_2$—.

Similarly in a preferred form Z is an aliphatic alkylene group containing between 2 and 4 carbon atoms and especially 3 carbon atoms. It is particularly preferred alkylene group has the structure —$CH_2CH_2CH_2$—.

The anion $Y^-$ in formulae (Ib) and (IIb) may be any suitable anion including a carboxylate, sulphate, sulphonate, chloride, bromide, iodide, fluoride, nitrate, phosphate etc. Preferably the anion is a carboxylate particularly an aliphatic or olefinic carboxylate of between 1 and 6 carbon atoms. More preferably the carboxylate is an aliphatic carboxylate of between 1 and 3 carbon atoms such as $HCO_2^-$, $CH_3CO_2^-$, $CH_3CH_2CO_2^-$. $CH_3CO_2^-$ is especially preferred.

The R group of compounds of formulae (Ia), (Ib), (IIa), and/or (IIb) is an aliphatic iso $C_{13}H_{27}$-group with average branching degree ranging from 1.5 to 3.5. The degree of branching is defined as the number of methyl groups in one molecule of R group minus 1. The average degree of branching is the statistical mean of the degree of branching of the molecules of a sample. The mean number of methyl groups in the molecules of a sample can easily be determined by $^1$H-NMR spectroscopy. For this purpose, the signal area corresponding to the methyl protons in the $^1$H-NMR spectrum of a sample is divided by three and then divided by the signal area of the methylene protons of the $CH_2O$—X group divided by two.

Preferably the average degree of branching is between 2.0 and 3.0, more preferably between 2.0 and 2.5.

Compounds of formula (Ia) may be prepared by the following process.

In a first step an alcohol ROH in which the R group is as defined previously can suitably be reacted with an ethylenically unsaturated nitrile containing between 3 and 6 carbon atoms to provide an alkyl ether nitrile. Suitable ethylenically unsaturated nitriles include acrylonitrile, methacrylonitrile, ethacrylonitrile, 2-n-propylacrylonitrile, 2-iso-propylacrylonitrile, 2-methyl-1-butenenitrile, 3-methyl-1-butenenitrile, 2,2-dimethyl-1-butenenitrile, 2,3-dimethyl-1-butenenitrile, 2-ethyl-1-butenenitrile, 3-ethyl-1-butenenitrile, 2-methyl-1-butenenitrile, 3-methyl-1-butenenitrile, 2,3-dimethyl-1-butenenitrile, 2-ethyl-1-butenenitrile, 1-pentenenitrile, 2-methyl-1-pentenenitrile, 3-methyl-1-pentenenitrile, 4-methyl-1-pentenenitrile. Preferably the ethylenically unsaturated nitrile would contain three carbon atoms i.e. acrylonitrile. It may be desirable to carry out this step in the presence of a base and a polar solvent. Typically the base may be an alkali metal alkoxide, preferably an alkali metal ethoxide or alkali metal methoxide, especially sodium methoxide. The ethylenically unsaturated nitrile may be added in an equivalent molar quantity to the alcohol. Usually the ethylenically unsaturated nitrile could also be added in a stoichiometric excess in order to ensure that all of the alcohol is reacted. Often the molar ratio of the ethylenically unsaturated nitrile to the alcohol can be above 1:1 and up to 10:1, preferably from 1:1 to 5:1, more desirably between 1:1 and 2:1.

The alcohol ROH may be obtained commercially from BASF or prepared according to the teaching of U.S. Pat. No. 6,963,014B (BASF AG, publication date 8 Nov. 2005).

It may be desirable to combine the ethylenically unsaturated nitrile with the alcohol already containing the base over a period of between 5 minutes and 75 minutes or more, It may be desirable to control the rate of combining the nitrile with the alcohol in order to ensure an optimum temperature is achieved. The reaction temperature may be between 10° C. and 60° C. It may be desirable to control the temperature such that it does not exceed 50° C. The reaction time may be over a period of at least 5 minutes and as long as 24 hours. Typically the reaction will be at least 5 minutes and often as much as 10 hours or more. At the end of the reaction it may be desirable to remove the excess ethylenically unsaturated nitrile by conventional means, for example by evaporation under vacuum. Suitably the ethylenically saturated nitrile may be removed under vacuum with a reduced pressure of between 15 mbar and 100 mbar at an elevated temperature of between 30° C. and 60° C. for a period of between 30 minutes and 180 minutes and optionally at an increased temperature of at least 65° C. and up to 85° C. Optionally it may be desirable to use a resin to remove any trace amounts of the nitrile. Desirably the resulting alkyl ether nitrile should have a purity of at least 90% and often at least 95%.

In a second step of the process the nitrile group of the alkyl ether nitrile of step one is reduced to the corresponding amine. This can be achieved by any conventional process for the reduction of nitriles to amines. Desirably the alkyl ether nitrile should be reacted with hydrogen in the presence of a suitable catalyst. An example of a suitable catalyst includes Raney-Cobalt. This may be carried out in the presence of a suitable aprotic solvent such as tetrahydrofuran.

Typically the reaction may be carried out at elevated temperatures, for instance at least 80° C., desirably at least 90° C., and possibly up to 140° C. or more. Preferably the reaction would be carried out at temperatures of between 100° C. and 130° C. In addition to elevated temperatures it may often be desirable to carry out process under increased pressure usually of at least 40 bar or more, for instance at least 45 bar. It may often be desirable to increase the pressure to even higher levels for instance up to 350 bar or higher, for instance between 250 bar and 300 bar. At the end of the reaction it may usually be desirable to remove the catalyst. This can be done by conventional filtration means.

Desirably the resulting alkyl ether amine should have a purity of at least 85% and often at least 89% or 90% or higher.

Compounds of formula (Ia) may be prepared also by the following process. In a first step an alcohol ROH in which the R group is as defined previously can suitably be reacted with 1 eq of alkylene oxide like ethylene oxide, propylene oxide, 1,-2-butylene oxide, 2,3-butylene oxide, 1,2-pentene oxide and/or 1,2-hexene oxide. Therefore alcohol ROH is mixed with a base like sodium hydroxide, potassium hydroxide or cesium hydroxide or aqueous solution out of it and reaction water is removed under reduced vacuum (15 to 100 mbar) at elevated temperature (80-120° C.) for suitable time. This could last between 0.5 and 3 hours. Reaction vessel is then flushed several times with nitrogen and heated to 100-160° C. Alkylene oxide is added in such a way that reaction temperature does not exceed 180° C. Optionally base can be neutralized with an acid (for example acetic acid) and resulting salt can be removed by simple filtration. Reaction leads to a mixture of showing a molecular weight distribution with an average alkoxylation degree of 1. Alkoxylation reaction can also be catalyzed by amines like imidazol or tertiary amines or double metal catalysts.

In a second step product from reaction before can be mixed with a suitable catalyst optionally in presence of an aprotic solvent like tetrahydrofurane. Reaction vessel is flushed several times with nitrogen in order to remove air. Afterwards ammonia (1-200 eq) and hydrogen (4-200 eq) are added up to a pressure of 50 bar. Reaction is heated under stirring to 200° C. Pressure should be kept below 280 bar. Further hydrogen is added (in case of pressure drop) and stirred over a period up to 24 h. Reaction is cooled to 40° C., gas is removed and vessel flushed several times with nitrogen. Catalyst can be removed by filtration and solvent can be removed under vacuum. Conversion of alcohol group into a primary amino group is at least 85% or even higher.

The compound of formula (Ib) may conveniently be prepared by addition of an acidic compound to the corresponding alkyl ether amine of formula (Ia). The acid compound will protonate the amine group and then the negatively charged acid radical will form the negatively charged $Y^-$ component. The acidic compound may be any suitable acid, for instance acids whose radicals are selected from the group consisting of carboxylate, sulphate, sulphonate, chloride, bromide, iodide, fluoride, nitrate, and phosphate. Preferably the acid is a carboxylic acid, particularly an aliphatic or olefinic carboxylic acid having between one and six carbon atoms. More preferably a carboxylic acid is an aliphatic carboxylic acid having between one and three carbon atoms i.e. formic acid, acetic acid or propionic acid. Acetic acid is preferred.

The acidic compound may be added in a molar equivalence to the alkyl ether amine compound of formula (Ia). It may be desirable to add a lesser amount of the acidic compound which will result in partial protonation and therefore result in a'mixture of the protonated compound of formula (Ib) and the corresponding alkyl ether amine compound of formula (Ia). It may also be desirable to add a greater amount of the acidic compound resulting in a stoichiometric excess of the acidic compound. Typically the ratio of acidic compound to alkyl ether amine may be between 1:10 and 1.5:1, especially between 1:7 and 1:1.

The acidic compound may be added over a period of time between one minute and 45 minutes to the alkyl ether amine, for instance between five minutes and 30 minutes. The resulting compound of formula (Ib) desirably will form as a homogenous solution which will remain clear and liquid during storage.

The alkyl ether diamine of formula (IIa) may be synthesised by reacting the alkyl ether amine of formula (Ia) with an ethylenically unsaturated nitrile containing between 3 and 6 carbon atoms to provide an alkyl ether amino alkyl nitrile. Suitable ethylenically unsaturated nitriles include acrylonitrile, methacrylonitrile, ethacrylonitrile, 2-n-propylacrylonitrile, 2-iso-propylacrylonitrile, 2-methyl-1-butenenitrile, 3-methyl-1-butenenitrile, 2,2-dimethyl-1-butenenitrile, 2,3-dimethyl-1-butenenitrile, 2-ethyl-1-butenenitrile, 3-ethyl-1-butenenitrile, 2-methyl-1-butenenitrile, 3-methyl-1-butenenitrile, 2,3-dimethyl-1-butenenitrile, 2-ethyl-1-butenenitrile, 1-pentenenitrile, 2-methyl-1-pentenenitrile, 3-methyl-1-pentenenitrile, 4-methyl-1-pentenenitrile. Preferably the ethylenically unsaturated nitrile would contain three carbon atoms i.e. acrylonitrile.

The ethylenically unsaturated nitrile may be added in an equivalent molar quantity to the alkyl ether amine. Usually the ethylenically unsaturated nitrile should be added in a stoichiometric excess in order to ensure that all of the alkyl ether amine is reacted. Often the molar ratio of the ethylenically unsaturated nitrile to the amine can be above 1:1 and up to 10:1, preferably from 1.5:1 to 5:1, more desirably between 2:1 and 4:1.

It may be desirable to combine the ethylenically unsaturated nitrile with the alkyl ether amine over a period of between 5 minutes and 75 minutes or more, preferably between 10 minutes and 45 minutes. It may be desirable to control the rate of combining the nitrile with the alcohol in order to ensure an optimum temperature is achieved. The reaction temperature may be between 20° C. and 60° C. It may be desirable to control the temperature such that it does not exceed 50° C. The reaction time may be over a period of at least 10 minutes and as long as 24 hours. Typically the reaction will be at least 30 minutes and often as much as 7 hours or more. At the end of the reaction it may be desirable to remove the excess ethylenically unsaturated nitrile by conventional means, for example by evaporation under vacuum. Suitably the ethylenically saturated nitrile may be removed under vacuum with a reduced pressure of between 15 mb and 25 mb at an elevated temperature of between 40° C. and 60° C. for a period of between 30 minutes and 60 minutes and optionally at an increased temperature of at least 65° C. and up to 85° C. Optionally it may be desirable to use a resin to remove any trace amounts of the nitrile. Desirably the resulting alkyl ether amino alkyl nitrile should have a purity of at least 55% and often at least 60%

In a second step of the process the nitrile group of the alkyl ether amino alkyl nitrile of step one is reduced to the corresponding amine. This can be achieved by any conventional process for the reduction of nitriles to amines. Desirably the alkyl ether amino alkyl nitrile should be reacted with hydrogen in the presence of a suitable catalyst. An example of suitable catalysts includes Raney-Cobalt. This may be carried out in the presence of a suitable aprotic solvent such as tetrahydrofuran.

Typically the reaction may be carried out at elevated temperatures, for instance at least 80° C., desirably at least 100° C., and possibly up to 140° C. or more. Preferably the reaction would be carried out at temperatures of between 110° C. and 130° C. In addition to elevated temperatures it may often be desirable to carry out process under increased pressure usually of at least 40 bar or more, for instance at least 45 bar. It may often be desirable to increase the pressure to even higher levels for instance up to 350 bar or higher, for instance between 250 bar and 300 bar. At the end of the reaction it may usually be desirable to remove the catalyst. This can be done by conventional filtration means.

Desirably the resulting alkyl ether diamine should have a purity of at least 55% and often at least 60% or higher.

The compound of formula (IIb) may conveniently be prepared by addition of an acidic compound to the corresponding alkyl ether amine of formula (Ia). The acid the compound will protonate the amine group and then the negatively charged acid radical will form the negatively charged $Y^-$ component. The acidic compound may be any suitable acid, for instance acids whose radicals are selected from the group consisting of carboxylate, sulphate, sulphonate, chloride, bromide, iodide, fluoride, nitrate, and phosphate. Preferably the acid is a carboxylic acid, particularly an aliphatic or olefinic carboxylic acid having between one and six carbon atoms. More preferably a carboxylic acid is an aliphatic carboxylic acid having between one and three carbon atoms i.e. formic acid, acetic acid or propionic acid. Acetic acid is preferred.

The acidic compound may be added in a molar equivalence to the alkyl ether diamine compound of formula (IIa). It may be desirable to add a lesser amount of the acidic compound which will result in partial protonation and therefore result in a mixture of the protonated compound of formula (IIb) and the corresponding alkyl ether diamine compound of formula (IIa). It may also be desirable to add a greater amount of the acidic compound resulting in a stoichiometric excess of the acidic compound. Typically the ratio of acidic compound to alkyl ether diamine may be between 1:25 and 1.5:1, especially between 1:20 and 1:1.

The acidic compound may be added drop wise over a period of time between one minute and 30 minutes to the alkyl ether amine, for instance between five minutes and 15 minutes. The resulting compound of formula (IIb) desirably will form as a homogenous solution which will remain clear and liquid during storage.

In the process according to the invention for enriching an iron mineral from a silicate containing iron ore by inverse flotation conventional inverse flotation plant equipment may be used. In general the iron ore can be combined with water or suitable aqueous liquid and mixed using mechanical mixing means to form a homogenous slurry. The flotation process is normally carried out in one or more flotation cells. The collector would normally be introduced into the slurry in the flotation cell. Typically the collector will condition the dispersed iron ore of the slurry. A suitable period of conditioning will tend to be at least one minute and sometimes as much as 10 or 15 minutes. Following the conditioning period air would tend to be injected into the base of the flotation cell and the air bubbles so formed would tend to rise to the surface and generate a froth on the surface. The injection of air may be continued until no more froth is formed, which may be for at least one minute and as much as 15 or 20 minutes. The froth can be collected and removed. In some cases it may be desirable to further treat the residual slurry again in a similar manner at least once for instance between 4 and 6 treatments. Nevertheless, it will generally be unnecessary to further treat the residual slurry again.

The flotation process may be performed in a conventional pH range. This may be in the range of between 5 and 12, such as 9 and 11. This tends to provide that the minerals would exhibit the correct surface charge.

A conventional depressing agent, such as a hydrophilic polysaccharide, may be used in a conventional quantity sufficient to cover the iron or surface in the requisite amount. Typically a suitable hydrophilic polysaccharide includes different kinds of starches.

It may also be desirable to include a froth regulator in the system in order to improve the efficiency. Nevertheless such froth regulators are not essential. Examples of conventional from regulators include methylisobutyl carbinol and alcohols having between six and 12 carbon atoms, such as ethylhexanol, and alkoxylated alcohols.

Further conventional additives may be included in the flotation system, such as pH regulating agents, co-collectors, and extender oils.

The typical ores of iron suitable for treatment according to the invention include haematite and magnetite ores. The invention is particularly suitable to haematite. Furthermore, the invention is suitable for processing of iron ores, for instance haematites containing high silica contents, for instance at least 20% by weight of iron ore, often at least 30%, and even at least 40% or more, for instance up to 60% or 70% or more.

The present invention is further illustrated by the following examples.

EXAMPLES

Synthesis

Following alcohols have been transformed into corresponding alkyl ether amines by conversion with acrylonitrile and reduction of nitrile group to amino group. Compounds were optionally treated with acetic acid afterwards. Alkyl ether diamines have been produced from corresponding alkyl ether amines by conversion with acrylonitrile and reduction of nitrile group to amino group. Compounds were optionally treated with acetic acid afterwards.

TABLE 1

| Alcohol | Description |
|---|---|
| $nC_{13}H_{27}OH$ | linear alcohol purchased by Aldrich (branching degree 0), not scope of the invention |
| TDN | Tridecanol N from BASF ($iC_{13}H_{27}OH$), produced by trimerization of butene followed by hydroformylation, primary alcohol with average branching degree ranging from 2.0 to 2.4 |
| TMN | 3,6,8,8-Tetramethylnonan-1-ol (branching degree 4), not scope of the invention |

Synthesis of TDN Ether Amine a) Addition

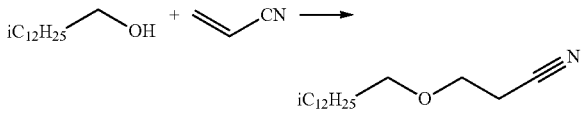

In a 1 l round bottom flask Tridekanol N (300 g, 1.5 mol) was stirred with NaOMe (30% solution in MeOH, 2.25 g, 0.013 mol at 21° C. acrylonitrile (159 g, 3.0 mol) was added during 45 min in such a way that temperature was kept below 50° C. Reaction was stirred overnight. Excess of acrylonitrile was removed under vacuum (20 mbar) at 50° C.

(and later at 75° C.) within 30 min. Ambosol (3 weight %) was added and mixture was filtrated (900 k Seitz filter).

According to gas chromatogram (GC) mixture contains 3.5% Tridekanol N and 96.4% addition product. Proton NMR confirmed the structure (proton nmr in $CDCl_3$: δ=0.65-1.80, m, 25H (CH, CH2, CH3), δ=2.6, t, 2H (CH2CN), δ=3.5, t, 2H (CH2O), δ=3.6, t, 2H (CH2O)).

b) Reduction

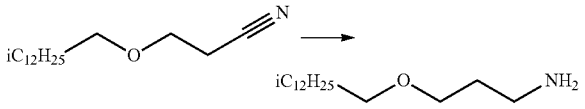

In a 300 ml autoclave tetrahydrofuran (25 g) was stirred with Raney-Cobalt (2.5 g) was flushed 3 times with nitrogen and stirred (500 rpm). Hydrogen (16.2 l) was added until pressure reached 50 bar and reactor was heated to 120° C. During 80 min reaction product from addition step of Tridekanol N and acrylic nitrile (80 g, 0.316 mol) was added continuously (flow rate 1 ml/min). Pressure was increased to 62 bar. Additional hydrogen was added (39.9 l) until pressure of 280 bar was reached. Mixture was stirred for 6 h under these conditions. Pressure was kept at 280 bar (14.86 l were added). Reactor was cooled to room temperature and pressure gently released. Autoclave was flushed with nitrogen (10 bar). Catalyst was removed by filtration (Seitz K 900). According to amine titer, GC and proton NMR (proton nmr in $CDCl_3$: δ=0.65-1.65, m, 25H (CH, CH2, CH3), δ=1.72, t, 2H (CH2), δ=2.8, t, 2H (CH2), δ=3.4, t, 2H (CH2O), δ=3.5, t, 2H (CH2O)) following values were achieved:

2.6% un-reacted nitrile
4.2% alcohol Tridekanol N
90% alkyl ether amine
2% side-product ("dimer").

c) Partial Protonation

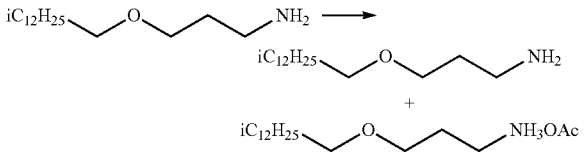

TDN-oxypropylamine (150 g, 0.583 mol) was stirred in a flask at room temperature. Acetic acid (7 g, 0.117 mol) was added drop-wise and stirred for 10 min. A homogeneous solution was observed, which stayed clear and liquid during storage for >6 months.

Synthesis of TDN Ether Diamine a) Addition

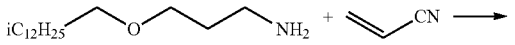

-continued

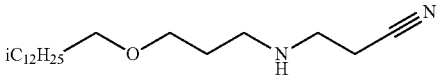

Tridecyloxypropylamine based on TDN (74 g, 0.28 mol) was stirred in a round bottom flask at 21° C. Acrylonitrile (16 g, 0.30 mol) was added during 15 min in such a way that temperature was kept below 50° C. Reaction was stirred for 3 h. Excess of acrylonitrile was removed under vacuum (20 mbar) at 50° C. (and later at 75° C.) within 30 min. According to amine titer, GC and proton NMR (proton nmr in $CDCl_3$: δ=0.65-1.65, m, 25H (CH, CH2, CH3), δ=1.75, t, (CH2), δ=2.5, t, (CH2CN), δ=2.75, t, (CH2), S=2.95, t, (CH2), δ=3.4, t, (CH2O), δ=3.5, t, (CH2O)) following values were achieved:

4.8% Tridekanol N
24.8% unreacted alkyl ether amine
2% alkyl ether nitrile
64.4% desired adduct.

b) Reduction

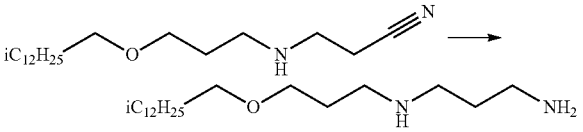

In a 300 ml autoclave tetrahydrofuran (25 g) was stirred with Raney-Cobalt (2.5 g) was flushed 3 times with nitrogen and stirred (500 rpm). Hydrogen (15.9 l) was added until pressure reached 50 bar and reactor was heated to 120° C. During 85 min reaction product from step before (80 g, 0.316 mol) was added continuous (flow rate 1 ml/min). Additional hydrogen was added (41.3 l) until pressure of 280 bar was reached. Mixture was stirred for 6 h under these conditions. Pressure was kept at 280 bar (5.99 l were added). Reactor was cooled to room temperature and pressure gently released. Autoclave was flushed with nitrogen (10 bar). Catalyst was removed by filtration (Seitz K 900). According to amine titer, GC and proton NMR (proton nmr in $CDCl_3$: δ=0.65-1.65, m, 25H (CH, CH2, CH3), δ=1.65, q, (CH2), δ=1.75, t, (CH2), δ=2.65, m, (CH2), 5=2.75, t, (CH2), δ=3.4, t, (CH2O), δ=3.5, t, (CH2O)) following values were achieved:

4.5% alcohol Tridekanol N
10% unreacted nitrile
21.6% alkyl ether amine
62.8% alkyl ether diamine
no side-product observed.

c) Partial Protonation

TDN-oxypropyl-1,3-propandiamine (314 g, 1.0 mol) was stirred in a flask at room temperature. Acetic acid (3 g, 0.05 mol) was added drop-wise and stirred for 10 min. A homogeneous solution was observed, which stayed clear and liquid during storage for >6 months.

The other samples were produced in similar way like TDN-oxypropylamine or TDN-oxypropyl-1,3-propandiamine.

Flotation Test

Following flotation protocol was applied for the different collectors.

500 g of dried iron ore (hematite) were poured in a 11 flotation vessel of a lab flotation cell (MN 935/5, HUMBOLDT WEDAG). 11 tab water was added and the resulting slurry was homogenized by stirring for two minutes (3000 rpm). 25 mL of a 1 weight % freshly prepared corn starch solution (=500 g/t ore) were mixed in. Subsequently, 25 μL of the liquid collector were injected (=50 g/t ore), pH was adjusted to 10 (with 50 weight-% NaOH solution) and the slurry was conditioned for 5 minutes. The air flow was started (80 L/h) and the froth was collected until no stable froth was formed. The air flow was stopped and another 25 μL of collector were added and conditioned for 5 minutes, before the air flow was restarted. This procedure was repeated until five addition steps were carried out. The flotation froth of each step was dried, weighted and the obtained minerals characterized by elementary analysis via X-ray fluorescence (XRF). The results are shown in table 2.

It can be seen from the test work that the collectors according to the invention provide a better all-round combination of increased removal of silicate and increased retention of the iron mineral.

TABLE 2

| | | pH | weight g | weight % | Fe | $Fe_{rec.}$ | $Fe_{rec}$ (Residue) | Si | $SiO_2$ | $SiO_2$ (Residue) | $SiO_{2\ rec.}$ |
|---|---|---|---|---|---|---|---|---|---|---|---|
| Flotigam EDA | Froth 1 | 10.5 | 8 | 1.6% | 25.3% | 1.1% | 98.9% | 24.8% | 53.1% | 43.7% | 1.9% |
| iC12oxypropylamine + | Froth 2 | 10.4 | 51 | 10.1% | 15.8% | 4.3% | 94.7% | 34.4% | 73.6% | 40.3% | 17.0% |
| 50% acetic acid | Froth 3 | 10.3 | 57 | 11.3% | 10.2% | 3.1% | 91.6% | 38.7% | 82.8% | 34.0% | 21.3% |
| (Comparative) | Froth 4 | 10.0 | 28 | 5.5% | 7.6% | 1.1% | 90.5% | 40.1% | 85.8% | 30.0% | 10.9% |
| | Froth 5 | 9.9 | 42 | 8.3% | 9.3% | 2.1% | 88.4% | 39.3% | 84.1% | 22.9% | 16.0% |
| | Residue | — | 319 | 63.2% | 52.3% | 88.4% | | 10.7% | 22.9% | | 33.0% |
| | Total | — | 505 | 100.0% | 37.4% | 100.0% | | 20.5% | 43.8% | | 100.0% |
| Aerosurf MG-83 | Froth 1 | 10.3 | 63 | 12.5% | 9.9% | 3.2% | 96.8% | 38.8% | 83.0% | 38.4% | 23.5% |
| iC13oxypropyl-1,3- | Froth 2 | 10.2 | 151 | 29.9% | 11.4% | 8.9% | 87.8% | 38.1% | 81.5% | 16.1% | 55.4% |
| propan diamine + | Froth 3 | 9.5 | 31 | 6.1% | 18.7% | 3.0% | 84.8% | 32.6% | 69.7% | 9.7% | 9.7% |
| 5% acetic acid | Froth 4 | 9.4 | 51 | 10.1% | 51.3% | 13.6% | 71.3% | 11.7% | 25.0% | 5.9% | 5.7% |
| (Comparative) | Froth 5 | 9.0 | 9 | 1.8% | 59.2% | 2.8% | 68.5% | 6.8% | 14.5% | 5.6% | 0.6% |
| | Residue | — | 200 | 39.6% | 66.1% | 68.5% | | 2.6% | 5.6% | | 5.0% |
| | Total | — | 505 | 100.0% | 38.2% | 100.0% | | 20.6% | 44.0% | | 100.0% |
| Lilaflot D 817M | Froth 1 | 10.2 | 47 | 9.3% | 9.7% | 2.4% | 97.6% | 38.8% | 83.0% | 39.3% | 17.9% |
| iC12oxypropyl-1,3- | Froth 2 | 10.0 | 43 | 8.5% | 11.9% | 2.7% | 95.0% | 37.5% | 80.2% | 35.0% | 15.8% |
| propan diamine + | Froth 3 | 9.6 | 11 | 2.2% | 7.5% | 0.4% | 94.5% | 40.9% | 87.5% | 33.6% | 4.4% |
| 20-40% acetic | Froth 4 | 9.6 | 16 | 3.2% | 10.5% | 0.9% | 93.6% | 38.7% | 82.8% | 31.6% | 6.1% |
| acid | Froth 5 | 9.5 | 16 | 3.2% | 16.5% | 1.4% | 92.3% | 34.6% | 74.0% | 29.7% | 5.4% |
| (Comparative) | Residue | — | 371 | 73.6% | 47.7% | 92.3% | | 13.9% | 29.7% | | 50.5% |
| | Total | — | 504 | 100.0% | 38.1% | 100.0% | | 20.3% | 43.4% | | 100.0% |
| Tridecyl- | Froth 1 | 10.7 | 0 | 0.0% | 0.0% | 0.0% | 100.0% | 0.0% | 0.0% | 43.5% | 0.0% |
| oxypropylamine # + | Froth 2 | 10.7 | 19 | 3.8% | 14.4% | 1.4% | 98.6% | 35.3% | 75.5% | 42.2% | 6.5% |
| 50% acetic acid | Froth 3 | 10.6 | 77 | 15.2% | 5.5% | 2.2% | 96.4% | 42.2% | 90.3% | 33.2% | 31.7% |
| | Froth 4 | 10.1 | 113 | 22.4% | 5.0% | 2.9% | 93.5% | 42.7% | 91.3% | 10.9% | 47.0% |
| | Froth 5 | 10.1 | 28 | 5.5% | 16.1% | 2.3% | 91.2% | 34.9% | 74.7% | 4.3% | 9.5% |
| | Residue | — | 268 | 53.1% | 66.5% | 91.2% | | 2.0% | 4.3% | | 5.2% |
| | Total | — | 505 | 100.0% | 38.7% | 100.0% | | 20.3% | 43.5% | | 100.0% |
| Tridecyloxypropyl- | Froth 1 | 10.2 | 23 | 4.6% | 2.9% | 0.3% | 99.7% | 40.6% | 86.9% | 39.9% | 9.4% |
| 1,3-propan- | Froth 2 | 10.2 | 141 | 27.9% | 4.9% | 3.6% | 96.1% | 40.0% | 85.6% | 21.0% | 56.8% |
| diamine # + | Froth 3 | 9.9 | 61 | 12.1% | 4.6% | 1.5% | 94.6% | 42.3% | 90.5% | 5.9% | 26.0% |
| 20% acetic acid | Froth 4 | 9.8 | 15 | 3.0% | 15.0% | 1.2% | 93.4% | 34.7% | 74.2% | 2.0% | 5.2% |
| | Froth 5 | 9.8 | 17 | 3.4% | 59.0% | 5.2% | 88.2% | 6.0% | 12.8% | 1.3% | 1.0% |
| | Residue | — | 248 | 49.1% | 68.3% | 88.2% | | 0.6% | 1.3% | | 1.5% |
| | Total | — | 505 | 100.0% | 38.0% | 100.0% | | 19.7% | 42.0% | | 100.0% |
| 3,6,8,8-tetra- | Froth 1 | 10.4 | 0 | 0.0% | 0.0% | 0.0% | 100.0% | 0.0% | 0.0% | 42.4% | 0.0% |
| methylnonan-1- | Froth 2 | 10.3 | 0 | 0.0% | 0.0% | 0.0% | 100.0% | 0.0% | 0.0% | 42.4% | 0.0% |
| amine + | Froth 3 | 10.3 | 109 | 21.7% | 5.4% | 3.0% | 97.0% | 42.1% | 90.1% | 29.2% | 46.1% |
| 50% acetic acid | Froth 4 | 10.0 | 67 | 13.3% | 4.8% | 1.6% | 95.4% | 42.6% | 91.1% | 16.4% | 28.7% |
| (based on TMN) | Froth 5 | 9.9 | 34 | 6.8% | 7.1% | 1.2% | 94.2% | 41.0% | 87.7% | 8.1% | 14.0% |
| (Comparative) | Residue | — | 292 | 58.2% | 63.5% | 94.2% | | 3.8% | 8.1% | | 11.2% |
| | Total | — | 502 | 100.0% | 39.2% | 100.0% | | 19.8% | 42.4% | | 100.0% |
| 50% (Tridecyl- | Froth 1 | 10.5 | 39 | 7.7% | 3.0% | 0.5% | 99.5% | 44.3% | 94.8% | | 22.3% |
| oxypropylamine # + | Froth 2 | 10.3 | 110 | 21.7% | 5.2% | 2.4% | 97.1% | 42.7% | 91.3% | 8.0% | 60.6% |
| 50% acetic acid) + | Froth 3 | 9.9 | 14 | 2.8% | 7.9% | 0.5% | 96.6% | 40.8% | 87.3% | 4.7% | 7.4% |
| 50% (Tridecyloxy- | Froth 4 | 9.9 | 10 | 2.0% | 34.0% | 1.4% | 95.2% | 22.8% | 48.8% | 3.4% | 2.9% |
| propyl- | Froth 5 | 9.8 | 6 | 1.2% | 34.0% | 0.9% | 94.3% | 22.8% | 48.8% | 2.6% | 1.8% |
| 1,3-propandiamine # + | Residue | — | 327 | 64.6% | 67.9% | 94.3% | | 1.2% | 2.6% | | 5.1% |
| 5% acetic acid) | Total | — | 506 | 100.0% | 46.5% | 100.0% | | 15.3% | 32.8% | | 100.0% |

# average branching degree ranging from 2.0 to 2.4.

The invention claimed is:

1. A process for enriching an iron mineral from a silicate-containing iron ore, the process comprising:

performing inverse flotation with a collector or collector formulation comprising at least one compound of any of formulae (Ia), (Ib), (IIa) and (IIb), to at least partially separate a silicate-containing mineral from the silicate-containing iron ore and provide an iron-enriched mineral:

$$RO—X—NH_2 \quad \text{(Ia);}$$

$$RO—X—NH_3^+Y^- \quad \text{(Ib);}$$

$$RO—X—NH—Z—NH_2 \quad \text{(IIa); and}$$

$$RO—X—NH—Z—NH_3^+Y^- \quad \text{(IIb),}$$

wherein

X is an aliphatic alkylene group containing 2 to 6 carbon atoms;

Z is an aliphatic alkylene group containing 2 to 6 carbon atoms;

$Y^-$ is an anion; and

R is an aliphatic iso $C_{13}H_{27}$-group with an average branching degree ranging from 2.0 to 2.5.

2. The process according to claim 1, wherein at least one of X and Z is a linear or branched alkylene group.

3. The process according to claim 2, wherein at least one of X and Z is a $—CH_2CH_2CH_2—$ moiety.

4. The process according to claim 1, wherein $Y^-$ of the compounds of formulae:

$$RO—X—NH_3^+Y^- \quad \text{(Ib); and}$$

$$RO—X—NH—Z—NH_3^+Y^- \quad \text{(IIb),}$$

is $CH_3CO_2^-$.

5. The process according to claim 1, wherein the collector or collector formulation comprises at least one compound selected from the group consisting of compounds of formulae (Ia) and (Ib) in combination with at least one compound selected from the group consisting of compounds of formulae (IIa) and (IIb).

6. The process according to claim 1, further comprising performing froth flotation.

7. The process according to claim 1, further comprising employing an additional frother.

8. The process according to claim 7, wherein the additional frother is either a branched aliphatic alcohol with 10 or less carbon atoms; and/or an alkyl ethoxylate.

9. The process according to claim 1, wherein the iron ore is haematite.

10. The process according to claim 1, further comprising adding a depressant.

11. The process according to claim 10, wherein the depressant is a starch.

12. The process according to claim 1, wherein R has an average degree of branching from 2.0 to 2.4.

13. The process according to claim 1, wherein the inverse flotation is carried out at a pH of from 9.8 to 10.7.

14. The process according to claim 1, wherein the collector or collector formulation further comprises 20-50% by weight of acetic acid.

15. The process according to claim 1, wherein the inverse flotation comprises five froth steps.

* * * * *